United States Patent [19]

Franklin

[11] 4,064,023

[45] Dec. 20, 1977

[54] ELECTROCHEMICAL GROWTH OF CALCIUM HYDROXIDE CRYSTALS FROM ELECTROLYTE SOLUTIONS

[75] Inventor: Alan D. Franklin, Washington, D.C.

[73] Assignee: The United States of America as represented by the Department of Health, Education and Welfare, Washington, D.C.

[21] Appl. No.: 712,767

[22] Filed: Aug. 9, 1976

[51] Int. Cl.[2] ..... C25B 1/20

[52] U.S. Cl. ..... 204/130

[58] Field of Search ..... 204/96, 130, 153

[56] References Cited

U.S. PATENT DOCUMENTS

| | | | |
|---|---|---|---|
| 3,082,160 | 3/1963 | Sabins | 204/96 |
| 3,957,604 | 5/1976 | Delfino | 204/130 |

FOREIGN PATENT DOCUMENTS

| | | | |
|---|---|---|---|
| 492,347 | 9/1938 | United Kingdom | 204/96 |

*Primary Examiner*—R. L. Andrews

*Attorney, Agent, or Firm*—John S. Roberts, Jr.; Norman J. Latker; Thomas G. Ferris

[57] ABSTRACT

An electrochemical crystal growth method wherein nutrient material (e.g., $Ca(OH)_2$) is continuously supplied to one electrode of a cell, is dissolved by electrolytic action, forming a concentration gradient, and concurrently is deposited (e.g., as $Ca(OH)_2$) near the other electrode in a predetermined amount dependent on the current through the cell. An electrolyte may be utilized which is selected from an aqueous mixture of an alkali metal salt and a soluble salt containing a metal ion in the product compound, crystals of which are to be grown. Alkaline earth hydroxides are preferred products and for growth of $Ca(OH)_2$ a preferred electrolyte is a mixture of calcium chloride and potassium chloride wherein the $Ca^{2+}$ ion is regulated between 0.05–0.5 molar. A highly preferred electrolyte mixture is 0.5 molar KCl and 0.5 molar $CaCl_2$ utilizing 1 mA current. The electrodes on the anode side may be constructed of any metal with low overvoltage for the oxidation of hydrogen (e.g., platinum or palladium of the platinum group metals) and the cathode is preferably copper or other metal with low overvoltage for the reduction of $H_2O$. The current density utilized is 0.1–3.0 mA and the EMF is at least 1.5 volts.

6 Claims, 1 Drawing Figure

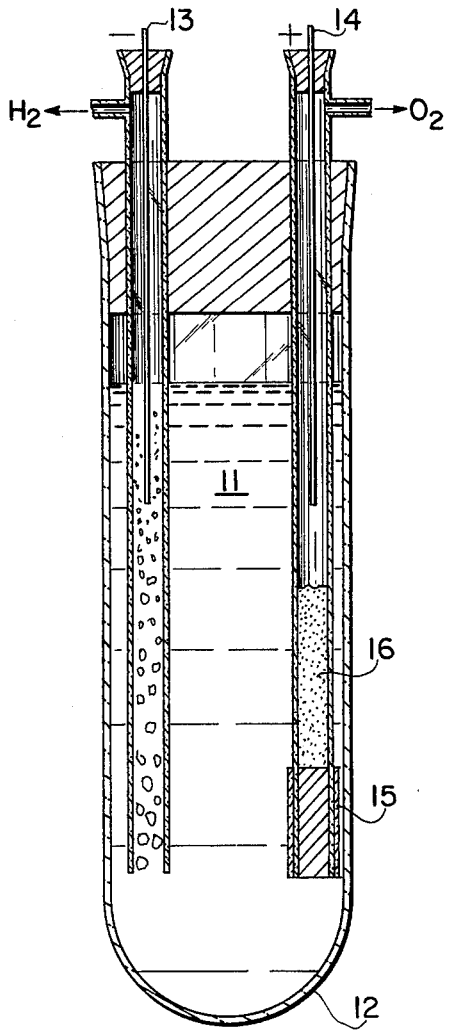
13
14
H2
O2
11
16
15
12

ELECTROCHEMICAL GROWTH OF CALCIUM HYDROXIDE CRYSTALS FROM ELECTROLYTE SOLUTIONS

The present invention relates to an electrochemical crystal-growth technique in which an electrolytic reaction involving one ion in the desired crystal is used to create a concentration gradient in that ion across the cell. Specifically, in the example of $Ca(OH)_2$ the OH− ion is involved and calcium hydroxide nutrient material which is held near the consuming electrode is dissolved with consequent crystal growth near the producing electrode occurring at a rate which can be controlled by the current through the cell. The present technique is demonstrated with the growth of $Ca(OH)_2$ crystals from aqueous solutions of a mixture of $CaCl_2$ and KCl.

The present invention is a variant from the usual known procedure of electrodeposition where the material that is deposited is a direct result of electrochemical reaction occurring as the current flows and deposits on the electrode. In the present invention the current is used to establish a gradient in thermodynamic activity of at least one of the constituents of the material to be crystallized, producing transport of the material from one electrode to the other. Deposition need not occur on the electrodes.

One attribute of the present invention is the ability in the process to add as necessary additional nutrient material; e.g., $CaOH_2$ to the anode, which, in effect, makes the method a continuous one.

In the present process there is a difference from the crystal growth processes using transport from nutrient to deposit by hydrothermal growth in that only in the present invention is the transport driven by activity or concentration gradient established by electrochemical reactions. In hydrothermal growth the transport is driven by activity or concentration gradients established by a temperature gradient.

In addition to the presently exemplified use, growing crystals of calcium hydroxide, other uses include growth of crystals from a variety of oxides, e.g., sapphire, quartz, garnet, periclase, or hydroxides, such as magnesium, and the purification of these compounds.

PRIOR ART

J. Kaspar et al, "A New Method for Growing Calcite Without Pressure," *Growth of Crystals* VI B, Consultants Bureau of New York, 1968, translated by George Fulford. This article describes a current-enhanced interdiffusion technique involving two solutions, one at each electrode. Sodium carbonate is used with an auxiliary electrode at the cathode and a soluble calcium salt such as calcium chloride is utilized at the anode. Crystallization is achieved on a glass fiber or crystalline nucleus near a crystallizer compartment filled with a solution of calcium carbonate interposed as a bridge between the two electrodes.

A further development of this system is described (in Czech) in an article by C. Barta and J. Zemlicka, Silikaty 10, 275 (1966), in which $NaHCO_3$ solution is used as a cathyolyte and $CaCl_2$ solution as an anolyte, with distilled water in the crystallizer compartment.

British Pat. No. 1,171,005. This teaching is different from the present invention in that it depends upon a high voltage direct current arc. The material is carried from one electrode to another through a high temperature gaseous plasma of the arc. The patent is directed to the production of cerium oxide or lanthanum oxide.

Franklin and Young, NBS Internal Report 75-628, pages 204, March 1975. This is earlier background material foregoing the present invention.

Contrasted with the above prior art, the present invention uses a technique in which the passage of current results in a concentration gradient of a critical ionic specie which in the case of the example (i.e., $Ca(OH)_2$) is OH−.

With reference to FIG. 1, electrolyte 11 which was a mixture of aqueous solution of KCl and $CaCl_2$ was placed in a large test tube 12. The cathode 13 was a copper wire in a 10 mm diameter glass tube about 15 cm long, the bottom of which was open to the solution in the cell. The anode 14 was a platinum wire in a similar tube, the tube terminating in a coarse glass frit 15 immersed in the electrolyte of the cell. Powdered $Ca(OH)_2$ 16 was held in the anode compartment by the frit.

In the practice of the present invention it was preferred to utilize as an anode a metal with a low overvoltage for the oxidation of hydrogen and preferably a platinum group metal such as platinum or palladium. Likewise, the selection of the cathode was made from a metal such as copper with a low overvoltage for the reduction of $H_2O$.

In the experiments corresponding with FIG. 1 above, current levels from 0.1–3.0 mA were tested with the currents being kept constant with a large resistance in series with the cell and a battery of 1.5 volts or greater which was sufficient to produce the desired current. A temperature was used consistent with the ambient temperature in the laboratory of $22 \pm 1°$–$2°$ C, but the temperature parameter was not critical. With reference to the ionic concentrations, the total cation content was kept near 1 molar. Growth of calcium hydroxide crystals was observed with $Ca^{2+}$ concentrations ranging from 0.05 to 0.5 molar and with currents of 1 mA or larger. A specially desirable electrolyte and current were found in the utilization of 0.5 molar KCl, 0.5 molar $CaCl_2$, and 1 mA current.

Nucleation of crystals was observed occurring on the inside walls of the glass tube surrounding the copper electrode after about 3 days. The nucleation or crystal buildup began on the wall opposite the electrode and was quite dense. As time passed, the band of nucleation moved down the tube, away from the cathode, and the crystals became fewer and larger the further they were from the electrode. The rationale as to the production of crystals is that the hydroxyl ions are produced in the cathode at a pH of about 11 and consumed at the anode at a pH of about 1–3. It is noted that additional nutrient can be added at any time to the anode. This concentration gradient produced a flux of hydroxyl ions and a counter flux of hydrogen ions from cathode to anode. In the anode compartment the powdered $Ca(OH)_2$ dissolved because of the low pH, while crystal growth occurred in the cathode compartment where the pH was high. There was therefore a concentration gradient and a flux of calcium ions from anode to cathode. The result was to transfer $Ca(OH)_2$ from anode to cathode compartment where the redeposition took place as crystal growth at a steady state rate which should be controlled by the current applied.

The results indicate that a steady state should not be achieved until the "zone of deposition" is moved down the wall of the cathode and the above experimental data suggest strongly that there is a stable position to the zone of deposition wherein the crystal growth of crystals should proceed in a steady state at the edge of the zone and further that the current control after nucleation at this limit may allow fine tuning of the steady state growth to produce controlled growth.

In a similar manner, this process would be applicable to the growth of crystals or purification of other alkaline earth hydroxides such as magnesium, strontium, and barium.

EXAMPLE

Large Horizontal Tube

In the fashion described ante with smaller tubes, an experiment was run with a larger tube.

In a cell with a long horizontal tube separating cathode from anode compartments in which the overall length from cathode to anode was 185 cm with a distance from the glass frit to the anode of 33 cm and a diameter of 2.5 cm, a zone of deposition was established at about 3cm from the cathode for a current of 6 mA, increasing to 5 cm for a 10 mA current.

Crystals up to 2mm in length were grown at the edge of this zone, although growth of masses of smaller crystals continued near the cathode. In this horizontal cell no convective stirring of the cathode compartment was possible, whereas in earlier cells with vertical cathode compartments convective stirring could occur. This stirring helped to maintain constant composition in the cathode compartment between the cathode and the zone of deposition so that growth of crystals took place primarily at the zone of deposition, resulting in a few large crystals. Thus, a cell with a vertical cathode compartment with a cathode at the top and long enough to establish a stable zone of deposition has a definite advantage in control over the crystal growth over other arrangements.

I claim:

1. An electrochemical crystal growth method wherein an alkaline earth hydroxide nutrient material is continuously supplied to the anode compartment, is dissolved by electrolytic action through formation of a concentration gradient of one or more ions of the crystallizing material and is deposited near the cathode in a predetermined amount dependent on the current through the cell, and wherein the electrolyte is an aqueous mixture of an alkali metal salt and a soluble salt containing a metal ion of the product alkaline earth hydroxide crystals.

2. The method according to claim 1 wherein the crystal to be grown is $Ca(OH)_2$ and the electrolyte is a mixture of calcium chloride and potassium or sodium chloride.

3. The method according to claim 1 wherein the soluble salt containing a metal ion in the product compound, crystals of which are to be grown, is calcium chloride, and $Ca^{2+}$ is utilized in a concentration of 0.05 molar.

4. The method according to claim 1 wherein the anode is a metal with low overvoltage for the oxidation of hydrogen, e.g., a platinum group metal selected from platinum and palladium, and the cathode is made of copper or other metal with low overvoltage for the reduction of $H_2O$.

5. The method according to claim 1 wherein the current utilized ranges from 0.1 to 3 mA and the EMF is at least 1.5 volts.

6. The method of claim 1 wherein the preferred electrolyte is a mixture of 0.5 molar KCl and 0.5 molar $CaCl_2$ utilized with a current density of 1 mA.

* * * * *